United States Patent [19]

Hino

[11] Patent Number: 4,498,205

[45] Date of Patent: Feb. 12, 1985

[54] MEDICAL BED WITH SHEET RETAINING MEANS

[75] Inventor: Kazuhiko Hino, Kanagawa, Japan

[73] Assignee: Fuji Electric Co., Ltd., Kanagawa, Japan

[21] Appl. No.: 445,781

[22] Filed: Dec. 1, 1982

[30] Foreign Application Priority Data

Dec. 1, 1981 [JP] Japan ..... 56-178803[U]

[51] Int. Cl.[3] ..... A47C 27/08; A47C 21/00

[52] U.S. Cl. ..... 5/449; 5/453; 5/498; 24/72.5

[58] Field of Search ..... 5/449, 450, 451, 453, 5/496, 498; 292/247; 297/218, 458, 456; 24/72.5

[56] References Cited

U.S. PATENT DOCUMENTS

| | | | |
|---|---|---|---|
| 87,742 | 3/1869 | Whitner | 5/498 |
| 1,082,929 | 12/1913 | Cartwright | 24/72.5 |
| 1,438,475 | 12/1922 | Bisbing | 24/72.5 |
| 1,481,223 | 1/1924 | Gorman et al. | 292/247 |
| 2,130,268 | 9/1938 | Craddock | 24/72.5 |
| 2,457,985 | 1/1949 | Dyson | 292/247 |
| 2,769,989 | 11/1956 | Woodford | 5/498 |
| 3,428,973 | 2/1969 | Hargest et al. | 297/456 |

FOREIGN PATENT DOCUMENTS

| | | | |
|---|---|---|---|
| 677814 | 3/1930 | France | 292/247 |

*Primary Examiner*—Alexander Grosz
*Assistant Examiner*—Vinh Luong
*Attorney, Agent, or Firm*—Sughrue, Mion, Zinn, Macpeak, and Seas

[57] ABSTRACT

A medical bed employing a fluidized particle media is improved by clamping the sheet thereof between the hand rails and the side flanges of the bed by means of a series of latch locks engaging latch hooks extending downwardly from the hand rails.

2 Claims, 10 Drawing Figures

MEDICAL BED WITH SHEET RETAINING MEANS

BACKGROUND OF THE INVENTION

This invention relates to an imporved medical bed in which, in order to reduce the contact pressure between the patient and the bed to thereby protect the patient from bed-sores, a solid particle media in the bed body is fluidized by blowing compressed air into the bed body from below, whereby the patient is made to float over the bed.

The arrangement of a conventional bed of this type and the operating principle of the same will be described with reference to FIGS. 1 and 2. In these figures, reference numeral 1 designates a bed; and 2, a patient lying on the bed 1. The bed 1 comprises a box-shaped bed body 3 which is large enough to allow a patient to lie thereon; and a solid particle media 4 filling the bed body 3, the solid particle media 4 being made up of ceramic pieces having a specific gravity between 2 and 3, and between 50 and 150μ in grain size, obtained by coating glass particles with resin. A gap-permeable filter sheet 5 has a mesh smaller than the grain size of the solid particle media 4, and is fixedly secured to the peripheral edge of the bed body 3. A bottom chamber 6 provided on the bottom of the bed body 3, and a porous air diffusing board 7 is disposed between the bottom chamber 6 and the bed body 3.

An air compressor 9 is provided in the rack 8 of the bed; and a compressed-air supplying pipe 10 is connected between the compressor 9 and the bottom chamber 6 through a compressed air blowing mechanism including a radiator 11.

When the compressor 9 is not in operation, the particle media 4 are at rest, and therefore the patient 2 on the bed feels as if he is lying on sand. In this condition, the compressor 9 is operated. As compressed air is supplied through the bottom chamber 6 and the air diffusing board 7 into the bed body 3, the particle media sealed in the bed body 3 by the filter sheet 5 are fluidized by the compressed air spread through the bed body and are ultimately floated. Under this condition, the apparent specific gravity of the particle media 4 is decreased to about 1.1 to 1.2, and the patient is supported while floating over the particle media. In this case, the contact pressure between the particle media and the patient is very low, and therefore the patient feels as if he is floating in air. The compressed air is continuously supplied into the bed body and is discharged into the room through the filter sheet 5. The temperature of the air discharged from the compressor 9 is increased by about 10° to 20° in the compression stroke. Blowing this high temperature air directly beneath the patient may lower the therapeutic effect. In order to eliminate this difficulty, the aforementioned radiator 11 is connected to the pipe 10.

With the medical bed as described above, air is continuously supplied to the bed body while the contact pressure to the patient is being reduced. Accordingly, a good effect can be expected, for instance, for a burned person. Furthermore, a seriously ill patient under medical treatment for a long period who cannot move by himself can be protected from bedsores, because the contact pressure between the patient and the bed is reduced.

In order to seal the particle media 4 within the bed body when fluidized by the operation of the air compressor, it is essential to fixedly secure the filter sheet, which covers the bed body 3, to the peripheral edge of the bed body in a manner such that the filter sheet is in close contact with the peripheral edge. For this purpose, the conventional medical bed as shown in FIGS. 3 through 5, has sheet retaining means comprising a plurality of hand rails 13 which can be readily set on the outer peripheral flange 12 of the bed body 3. The hand rails 13 are fixedly secured to the flange 12 of the bed body 3, in such a manner that the sheet 5 is held between the flange 12 and the hand rails 13 and is in close contact with the flange 12 through a retaining packing 14.

Heretofore, in order to secure the hand rails 13 to the bed body 3, a plurality of bolts 15 were embedded in the lower surface of each hand rail 13 at suitable intervals, as shown in FIG. 4, while bolt inserting holes were cut in the sheet 5 and in the flange of the bed body 3. The bolts were then inserted into the holes in the sheet and the flange to retain the sheet 5 from above by the hand rails as shown in FIG. 3, and knurled knobs 16 were screwed onto the bolts thus inserted, to fixedly secure the sheet to the bed body 3. Twenty to thirty bolts 15 were arranged on the flange of the bed body, and therefore, required a relatively long period of time, and was troublesome. If the bolts are not sufficiently tightened, the particle media is blown from the bed. This changing operation must be carried out whenever the sheet becomes dirty, and is generally conducted by nurses. Accordingly, it is desirable that the sheet fixing work be readily achievable even by unskilled persons.

SUMMARY OF THE INVENTION

In view of the foregoing, an object of this invention is to provide an improved medical bed wherein the sheet can be readily and positively secured to the bed.

DETAILED DESCRIPTION OF THE PREFERRED EMBODIMENTS

One embodiment of this invention will now be described with reference to FIGS. 6 and 7.

Figure 1:
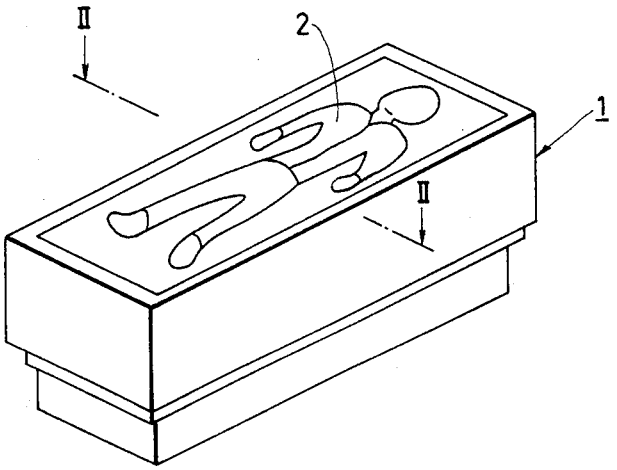
FIG. 1 is a perspective view of a medical bed to which the technical concept of this invention is applied.
Figure 2:
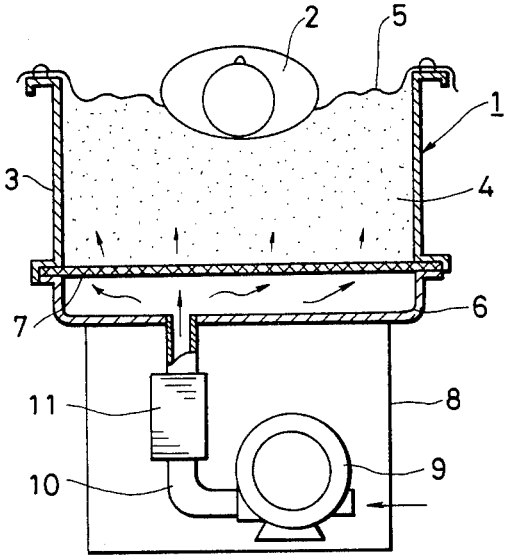
FIG. 2 is a sectional view taken along the line II—II of FIG. 1.
Figure 3:
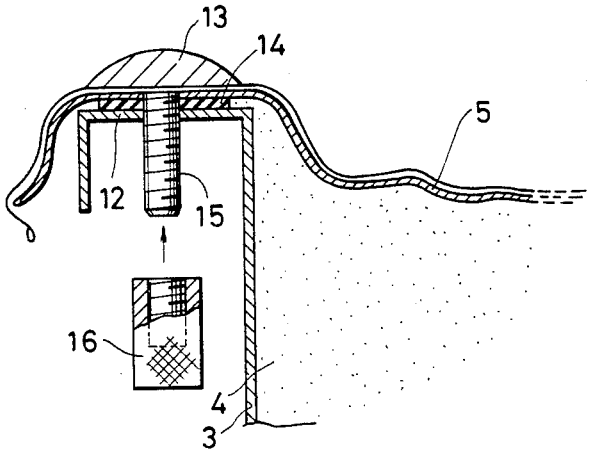
FIG. 3 is an enlarged sectional view showing conventional sheet retaining means.
Figure 4A:
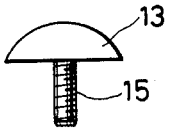
FIGS. 4(A) and 4(B) are an end view and a bottom view of a hand rail, respectively.
Figure 4B:
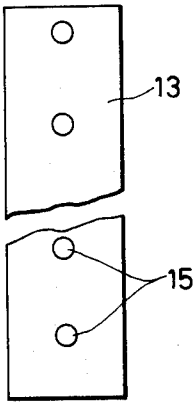
Figure 5:
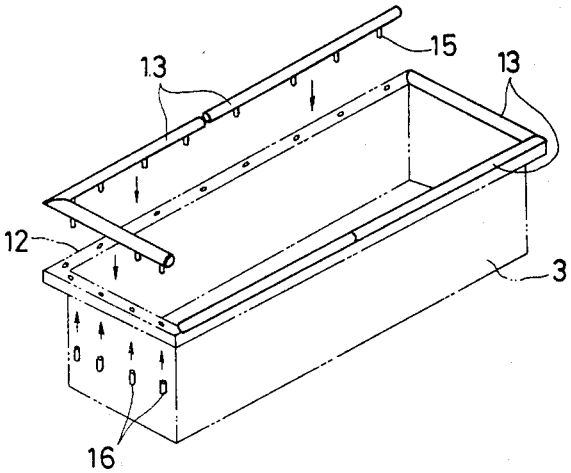
FIG. 5 is a perspective view showing the arrangement of the hand rails.
Figure 6:
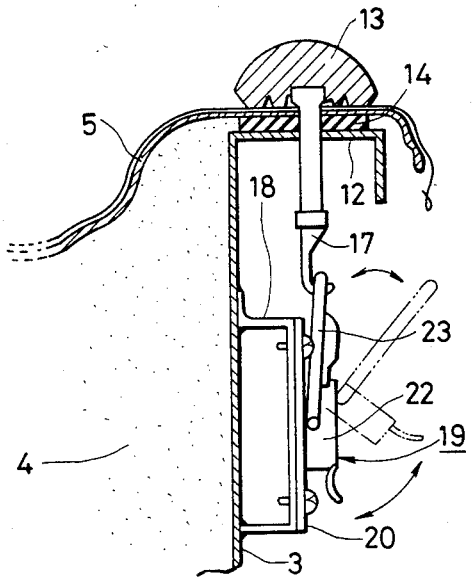
FIGS. 6 and 7 are an enlarged sectional view and a front view showing the essential parts of one embodiment of this invention, respectively.
Figure 7:
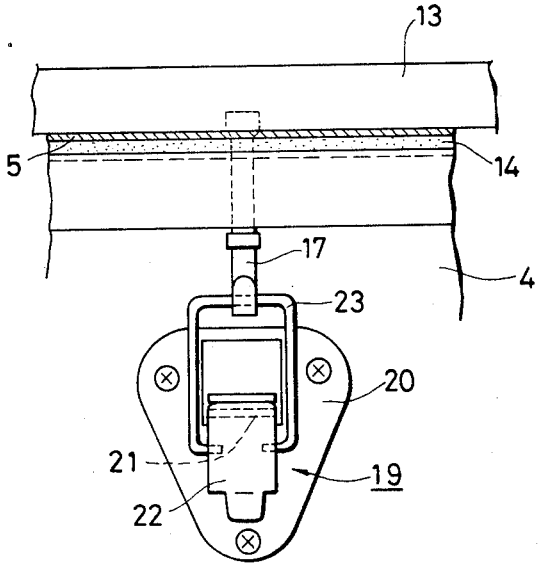

As shown in FIGS. 6 and 7, instead of bolts, hook bars 17 are embedded in each hand rail 13. A mounting stand 18 and a latch lock 19 are provided at a position on the outer wall of the bed body 3 which corresponds to the position of each hook bar 17. The latch lock 19 comprises a base plate 20, a handle 22 pivotally mounted on a pin 21 which is secured to the base plate 20, and a latch 23 which is coupled to the handle 22 in such a manner that the rotary axis thereof is shifted from the pin 21.

The operation of the latch lock thus constructed is as follows. When the handle 22 is moved to the position indicated by the chain line in FIG. 6, the latch 23 is engaged with the hook bar 17, and then the handle 22 is turned to the position indicated by the solid line. As a result, the hook bar 17 is pulled downwardly, so that the hand rail 13 is pushed against the upper surface of the flange 12 of the bed body 3. By reversing the above-described operating procedure, the latch 23 is disengaged from the hook bar 17. In mounting the latch lock 19, it is essential to correctly determine the height of the mounting stand 18 by taking the lines of action of the forces into consideration.

Figure 8A:
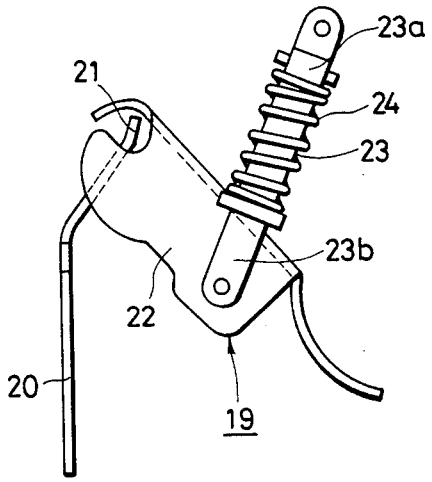
FIGS. 8(A) and 8(B) are a side view and a front view of one modification of a latch lock of FIGS. 6 and 7.
Figure 8B:
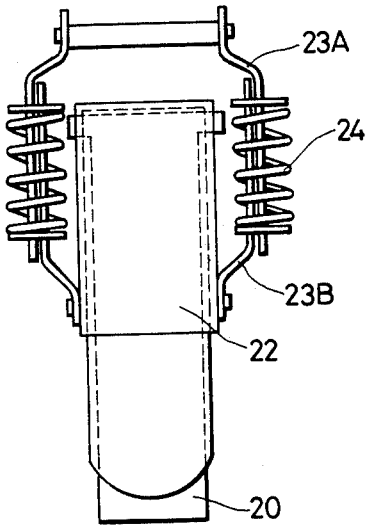

FIGS. 8(A) and 8(B) show one modification of the latch lock 19. The latch lock of FIGS. 8 is substantially different from that of FIGS. 6 and 7 in that its latch 23 is elastically operated. The latch 23, as shown in FIG. 8, comprises an end part 23*a* and a base part 23*b*. Each of the parts 23*a* and 23*b* have right and left arms. The right and left arms of the parts 23*a* and 23*b* are coupled through coil springs 23 as shown in FIGS. 8, respectively. The right and left arms have protrusions at their ends, in order to retain the coil springs 24. After the latch 23 of the latch lock is engaged with the hook bar 17, the handle 22 is pulled down. As a result, the coil springs 24 are compressed, to provide a suitable tightening force.

Thus, according to the invention, the hand rails can be secured to or removed from the bed body by a simple one-step operation. Accordingly, the sheet can be replaced more quickly and positively. Since the sheet is completely secured to the bed body by this one action, the medical bed of the invention is free from the problem that the hand rails are not sufficiently secured to the flange of the bed body because bolts are employed. It can be detected at a glance whether or not the latch lock is sufficiently engaged with the hook bar, according to the invention. Accordingly, the present bed has practical advantages in that the latch lock is in positive engagement at all times and the blowing of the particle media from the bed can be prevented.

What is claimed is:

1. A medical bed of the type wherein a sheet covers a solid particle media in a bed body and compressed air is supplied into said bed body to fluidize said solid particle media whereby a patient lying on said sheet may be supported, said bed comprising;

a box-shaped bed body filled with a solid particle media, said bed body having a peripheral flange;

a packing member covering a surface of said peripheral flange;

a gas-permeable filter sheet placed over said bed body and packing member;

sheet-retaining hand rails for pressing said sheet against said packing member whereby said solid particle media are sealed in said bed body, said hand rails having a plurality of hook portions extending through said sheet, said packing member and said flange; and clamping means for pulling said hook portions to urge said hand rails uniformly against said sheet around the entire periphery of said flange, said clamping means comprising latch lock coupling means mounted on an exterior of said bed body and including loop-like coupling means for engaging said hook portions.

2. An apparatus as claimed in claim 1, said loop-like means comprising a pair of members partially arranged overlapping one another and being spring biased toward an increasing degree of overlap.

* * * * *